US006044812A

United States Patent [19]

Bivens

[11] Patent Number: 6,044,812

[45] **Date of Patent: *Apr. 4, 2000**

[54] DIESEL ENGINE, MODIFICATION, AND METHOD

[76] Inventor: Jack L. Bivens, 1191 Morse Blvd., Riviera Beach, Fla. 33404

[ * ] Notice: Under 35 U.S.C. 154(b), the term of this patent shall be extended for 384 days.

[21] Appl. No.: 08/714,954

[22] Filed: Sep. 17, 1996

Related U.S. Application Data

[62] Division of application No. 08/521,530, Aug. 30, 1995, Pat. No. 5,590,625.

[51] Int. Cl.[7] ..... F02R 75/04

[52] U.S. Cl. ..... 123/65 R; 123/65 BA; 123/65 VC

[58] Field of Search ..... 123/48 C, 48 B, 123/48 R, 65 R, 65 BA, 65 A, 65 VC, 65 P

[56] References Cited

U.S. PATENT DOCUMENTS 5,197,432 3/1993 Ballheimer ..... 123/78 C

*Primary Examiner*—Noah P. Kamen
*Attorney, Agent, or Firm*—Jack E. Dominik

[57] ABSTRACT

The modification of the exhaust valve of a two cycle diesel engine in order to increase the amount of the valve stem travel and hence larger annular opening, without changing the total time period or degrees of crank shaft rotation during which time the exhaust valve is open and permits the combusted fuel air mixture to exhaust is disclosed. In cooperation with the improved valve opening, the intake port for the intake air is lowered and lengthened to therefore permit a longer power stroke, and the input of more air which, when combined with the improved scavenging, increases the amount of oxygen available for combustion. The increase in the opening of the valve is achieved by shortening one of the two arms of the rocker arm which engages the valve stem, the arm shortened being the arm which is activated by the push rod. This results in a lengthening of the stroke of the valve stem and the valve which translates into a larger annular opening for exhaust. In addition, the exhaust sector of the 180° of the power stroke is delayed by retarding the exhaust valve cam shaft to a point where the piston is further down the cylinder, and the air intake port is similarly lowered. Finally, in combination with the foregoing, the crank shaft throw is extended, while the connecting rod is shortened somewhat in order to increase the travel of the power stroke by approximately 5%. The fuel injection-timing remains essentially the same as with the original style engine. In order to avoid seriously increasing the compression ratio of about 17:1, the piston is modified to a desirably modified domed configuration.

4 Claims, 9 Drawing Sheets

DIESEL ENGINE, MODIFICATION, AND METHOD

CROSS-REFERENCE TO RELATED APPLICATION

The present application is a division of application Ser. No. 08/521,530, filed Aug. 30, 1995 by the same inventor herein and entitled "Diesel Engine, Modification, and Method", allowed on Jun. 26, 1996 and now U.S. Pat. No. 5,590,625, issued Jan. 7, 1997.

FIELD OF THE INVENTION

The present invention relates to diesel engines, and more particularly the two cycle variety in which the intake is ported, the exhaust is valved, and fuel is injected at the end of the compression stroke.

BACKGROUND OF THE INVENTION

The background of the invention is specifically addressed to the Detroit Diesel Series 92 Turbo Charged Engine. The Detroit Diesel two stroke engine is highly reliable and develops acceptable fuel efficiency in the order of eighteen horse power per gallon per hour at approximately 735 horse power for an 8V92 T.A.B. Normally the exhaust manifold pressure should be 75% of the intake blower and turbo pressure of 30 psi or 23 psi at full power. If these pressures become imbalanced, reverse intake occurs. The subject engine uses a roots blower fed by an exhaust driven turbo to force the pressure of the incoming air to up to 30 psi. As the revolutions per minute increase from 1500 revolutions per minute, approximately 50% horse power, to 1950 revolutions per minute at 50 revolutions per minute intervals, the increase in air box pressure to exhaust pressure to turbo boost, increase on a well-balanced basis. However, in increasing the revolutions per minute from 1950 rpm to 2350 rpm, the air box pressure increases from 22 psi to 32 psi, but the turbo boost increases only from 20 psi to 24 psi. The present invention, in part, is inspired by a desire to increase the turbo boost at the same rate of the other pressure increases, and at the same time deliver an increased horse power per gallon per hour at all operating speeds.

SUMMARY OF THE INVENTION

The present invention is directed to and achieves a major portion of its effectiveness from the modification of the exhaust valve of a two cycle diesel engine in order to increase the amount of the valve stem travel and hence larger annular opening, without changing the total time period or degrees of crank shaft rotation during which time the exhaust valve is open and permits the combusted fuel air mixture to exhaust. In cooperation with the improved valve opening, the intake port for the intake air is lowered and lengthened to therefore permit a longer power stroke, and the input of more air which, when combined with the improved scavenging, increases the amount of oxygen available for combustion. The increase in the opening of the valve is achieved by shortening one of the two arms of the rocker arm which engages the valve stem, the arm shortened being the arm which is activated by the push rod. This results in a lengthening of the stroke of the valve stem and the valve which translates into a larger annular opening for exhaust. In addition, the exhaust sector of the 180° of the power stroke is delayed by retarding the exhaust valve cam shaft to a point where the piston is further down the cylinder, and the air intake port is similarly lowered. Finally, in combination with the foregoing, the crank shaft throw is extended, while the connecting rod is shortened somewhat in order to increase the travel of the power stroke by approximately 5%. The fuel injection timing remains essentially the same as with the original style engine. In order to avoid seriously increasing the compression ratio of about 17:1, the piston is modified to a desirably modified domed configuration.

In view of the foregoing it is a principle object of the present invention to provide timed modifications to a two-cycle diesel engine which will increase the horse power per BTU input.

A further object of the present invention is to provide the increase in efficiency of fuel to horse power ratio, while at the same time permitting for cleaner burning and reduced if not eliminated back pressure in the air box.

A further object of the further invention is to reduce the pressure within the cylinder at the point when the exhaust takes place to effectuate a lesser back pressure at the time of exhaust thereby permitting the pressure air which has been fed by the blower, which in turn has been assisted by the turbo charger.

A most important object of the present invention is to achieve the foregoing without significantly increasing the inherent cost of the engine structure.

BRIEF DESCRIPTION OF THE DRAWINGS

The foregoing objects of the present invention as well as the invention itself will be better understood in the context of the accompanying illustrative drawings, in which.

DESCRIPTION OF A PREFERRED EMBODIMENT

Figure 1A:
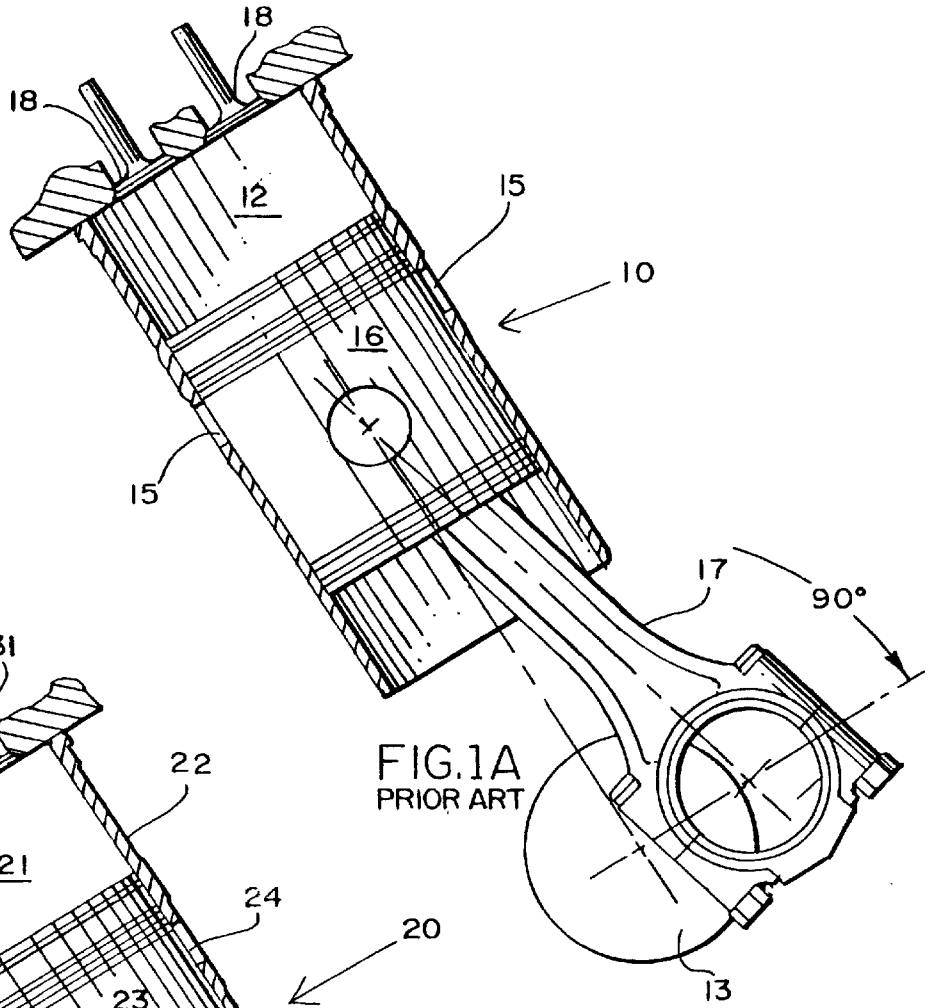
FIG.1A PRIOR ART
FIGS. 1A/1B–7A/7B contrast the prior art Detroit Diesel Model 8V92 with the A series drawings to the engine cycle illustrative of the present invention identified by the B series. The travel is from top dead center to bottom dead center back to top dead center again.

Before describing the preferred embodiment in detail, comments need to be made as to the principal prior art which is the Detroit Diesel Corporation high performance 92TAB Series Engine. That engine had chronic problems which includes 100 to 200 hours of engine life with 1,500 hours considered to be the maximum under light load conditions. The same problem manifests itself in the Detroit Diesel smaller 71 Series high performance engines. The applicant determined early that a principal cause of the problem was faulty design which caused reverse intake. The prior art engines were invariably susceptible of a large build-up of soot or combustion residue in the air inlet chamber (air box) which surrounds the cylinder. Sometimes the build-up could be as thick as one inch, with the liner inlet ports being almost completely clogged. The condition was diagnosed as caused by combustion residue (exhaust) blowing back through the air intake ports, namely, reverse intake. Indeed, the result was a reversal of the intake cycle at the beginning of the intake portion of the exhaust stroke. As the piston travelled downwardly during the power stroke in the prior art two-cycle engine, the exhaust valves would begin to open, and then as the piston travelled further downward the liner air intake ports were uncovered by the pistol. At that time the air box pressure (which is the combination of the turbo charger and mechanical blower pressure) should be greater than the residual exhaust pressure left in the cylinder at the time so that scavenging and fresh air charge can occur efficiently and simultaneously. The prior art design, however, did not accommodate this balance and the residual exhaust pressure was greater than the air box pressure at the time the intake ports were open. This resulted in blowing soot and exhaust back into the air chamber and interrupting the scavenging cycle. The resulting soot build-up in the air box and liner intake ports caused a rapid decrease in horse power output and fuel economy. Moreover, this caused excessive exhaust smoke and exhaust emissions, and ultimate early engine failure.

In accordance with the invention as expressed in the Summary, the thrust of the present invention is directed to modifying a pre-existing engine such as exemplified by the Detroit Diesel Series 92 Turbo Charged Engine. While it could be said that the Series 92 is the subject of a "modification", and it could be said that the present invention relates to a kit to modify the Detroit Diesel 92, it can also be said that the present invention is directed to a new engine. The length of the connecting rod has been shortened, the throw of the crank shaft has been increased, which results in a lengthened power stroke. The amount of opening of the exhaust valve has been increased, and the positioning of the intake port as well as its size has been lowered to accommodate the lengthened power stroke. All of the above are modified for a different timed relationship in the overall context of the 360° cycle commencing when the piston crosses top dead center. The foregoing are independent of whether the injection is mechanically metered or electronically metered. Bearing this in mind, the following description will proceed in conjunction with the accompanying drawings to contrast the various elements combined in the invention with the prior-art engine as exemplified by the Detroit Diesel Series 92 Turbo Charged Engine. More specifically, a review of the prior art Diesel Series 92 Turbine Charged Engine appears in the Detroit diesel literature of October 1988, and addresses itself particularly to FIG. 8A–D of the drawings of the present application as follows:

The diesel engine is an internal combustion power unit, in which the heat of fuel is converted into work in the cylinder of the engine. In the diesel engine, air alone is compressed in the cylinder; then, after the air has been compressed, a charge of fuel is sprayed into the cylinder and ignition is accomplished by the heat of compression.

The Two Cycle Principle

In the two-cycle engine 10, intake and exhaust take place during part of the compression and power strokes respectively (FIG. 8A–D). In contrast, a four-cycle engine requires four piston strokes to complete an operating cycle; thus, during one half of its operation, the four-cycle engine functions merely as an air pump.

Figure 8A:
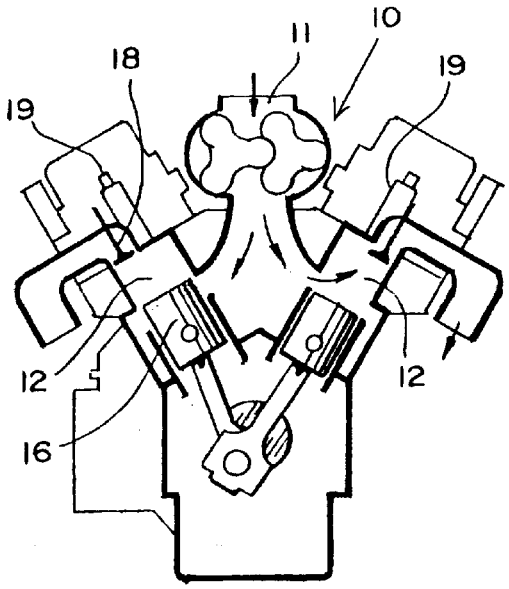
FIG. 8A PRIOR ART
FIGS. 8A–8D are exemplary of the prior art Detroit Diesel 92.
Figure 8B:
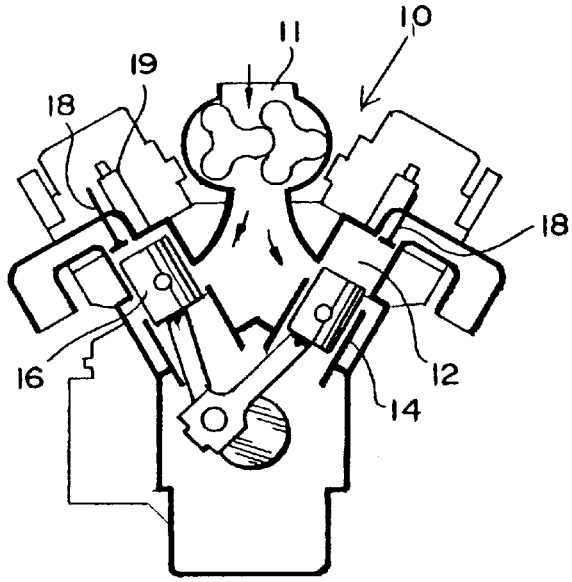

A blower 11 is provided to force air into the cylinders 12 for expelling the exhaust gases and to supply the cylinders with fresh air for combustion. The cylinder wall 14 contains a row of ports 15 which are mostly above the piston 16 when it is at the bottom of its stroke. These ports 15 admit the air from the blower 11 into the cylinder 12 as soon as the rim of the piston uncovers the ports 15 (FIG. 8A—scavenging). The unidirectional flow of air toward the exhaust valves 18 produces a scavenging effect, leaving the cylinders 12 full of clean air when the piston 16 again covers the inlet ports 15. As the piston 16 continues on the upward stroke, the exhaust valves 18 close and the charge of fresh air is subjected to compression (FIG. 8B—Compression).

Figure 8C:
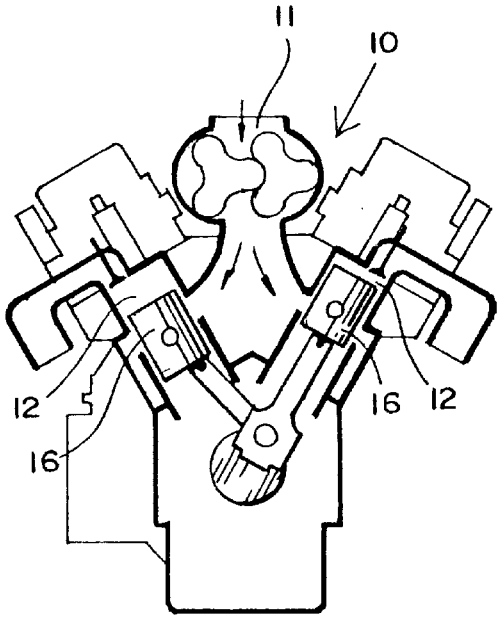

Shortly before the piston reaches its highest position, the required amount of fuel is sprayed into the combustion chamber by the unit fuel injector 19 (FIG. 8C—Power). The intense heat generated during the high compression of the air ignites the fine fuel spray immediately. The combustion continues until the fuel injected has been burned.

Figure 8D:
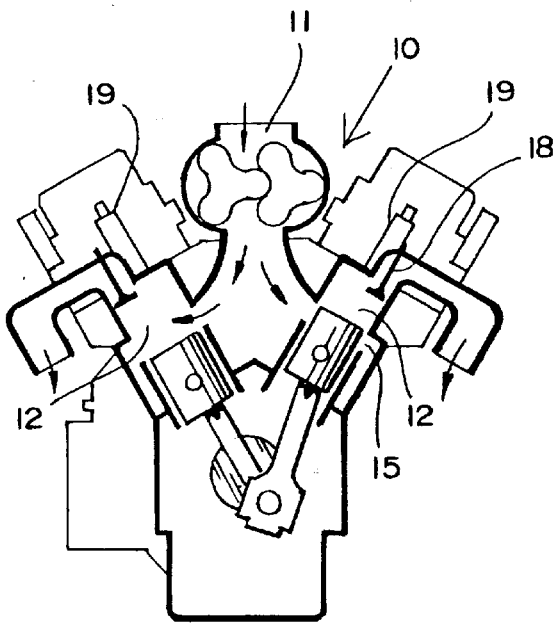

The resulting pressure forces the piston downward on its power stroke. The exhaust valves are again opened when the piston is about half way down, allowing the burned gases to escape into the exhaust manifold (FIG. 8D—Exhaust). Shortly thereafter, the downward moving piston uncovers the inlet ports and the cylinder is again swept with clean scavenging air. This entire combustion cycle is completed in each cylinder for each revolution of the crank shaft, or, in other words, in two strokes; hence, it is a "two-stroke cycle".

Exemplary of the present diesel engine 20 of the invention as shown in FIGS. 1B–7B, and contrasted with the prior art shown in FIGS. 1A–7A, it will be seen that the cylinder 21 and its liner 22 differ from the prior art in that the ports 24, which are basically are shaped with a minor axis around the circumference of the cylinder and a major axis vertically along the cylinder wall, have been lowered from the traditional prior-art location. This, in combination with the longer stroke which is made possible by the lengthened crank shaft 25 throw, and the reduced piston rod 26 length, contribute to a lengthening of the power stroke within the spacial environment of the prior art. To accommodate a greater amount of exhaust in the condition exemplified in the prior art by FIG. 8D, the rocker arm of the present invention is modified to shorten that portion which is activated by the cam shaft push rod, without changing the dimension of that portion of the arm which presses upon the valve stem. The shortening of the active arm and relative lengthening of the acted upon arm increases the stroke of the exhaust valve stem and the concomitant opening of the exhaust valve. This in turn creates a larger annulus around the exhaust valve 31 which permits the exhaust to exit with less back pressure. By rotating the exhaust valve cam shaft (not shown) the exhaust cycle can be delayed for the approximate amount of the lengthening of the power stroke since the cam shaft dwell time during the 360° rotation is not changed, but rather shifted to a more retarded location to thereby insure that the power stroke is lengthened.

More specifically, a comparison between the prior art design and the new design is made in FIGS. 1A–B through 7A–B. These include the following:

FIG. 1A: During the main power stroke the prior-art crankshaft 13 rotates 90° before the exhaust valve 18 starts to open. This gives a mean effective power stroke 2.814 inches. This early valve opening is necessary to prevent exhaust blow back through liner intake ports.

Figure 1B:
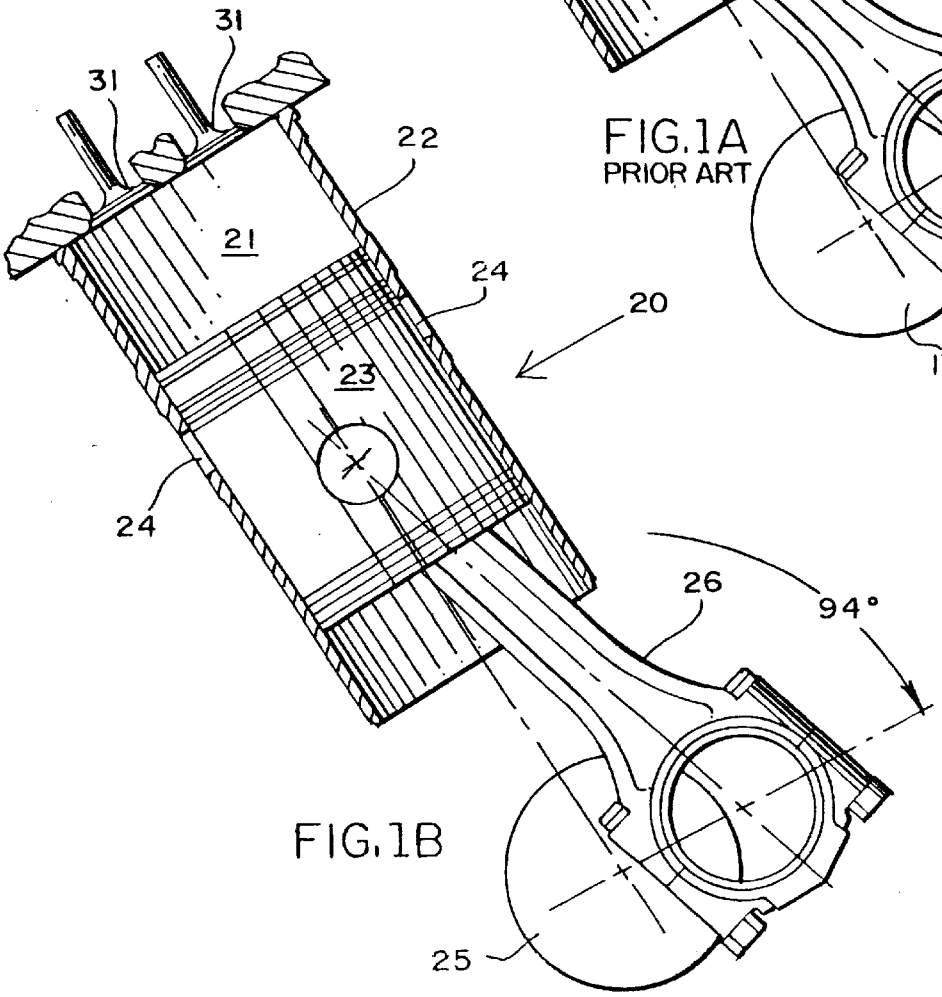

FIG. 1B: During the main power stroke of the present invention 20, the crankshaft 25 rotates 94° before exhaust valve 31 starts to open giving a mean effective power stroke 3.125 inches. This is possible due to the lower position of the liner intake ports 24 and longer throw on crank shaft 25. This is a gain of 11% in mean effective power stroke.

Figures 2A, 2B:
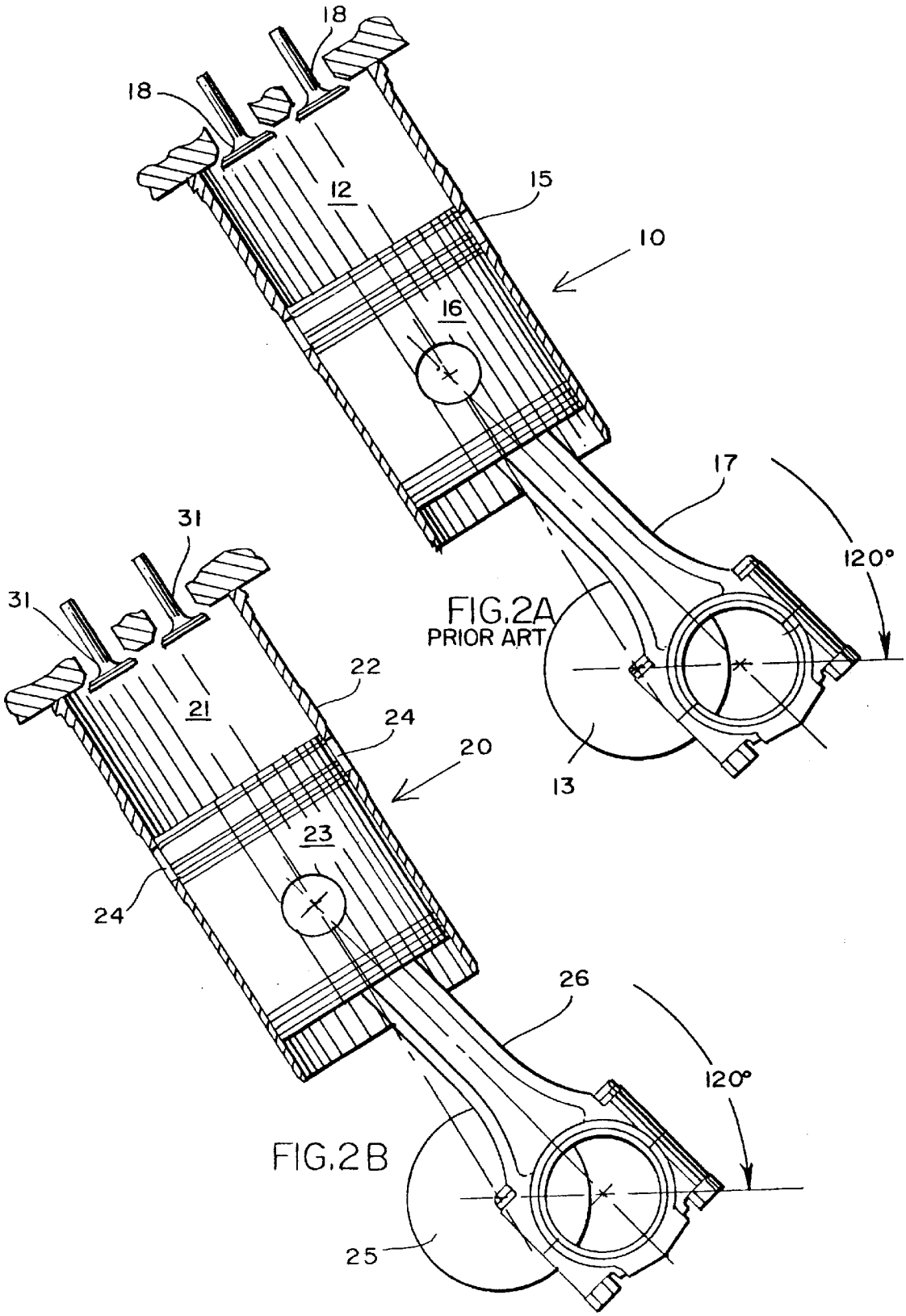
FIG.2A PRIOR ART

FIG. 2A: At 120° of crankshaft 13 rotation the exhaust valves 18 are open 0.221 inch, and the piston 16 has travelled 3.984 inches from T.D.C. while the liner air inlet ports 15 are still closed.

FIG. 2B: At 120° crankshaft 25 rotation the exhaust valves 31 are open 0.244 inch, an increase of 15% in volume of space for exhaust out flow. The piston has travelled 4.156 inches from T.D.C., an increase of 5% in cylinder volume to allow for additional power stroke and combusted material expansion before the liner intake ports open.

Figure 3A:
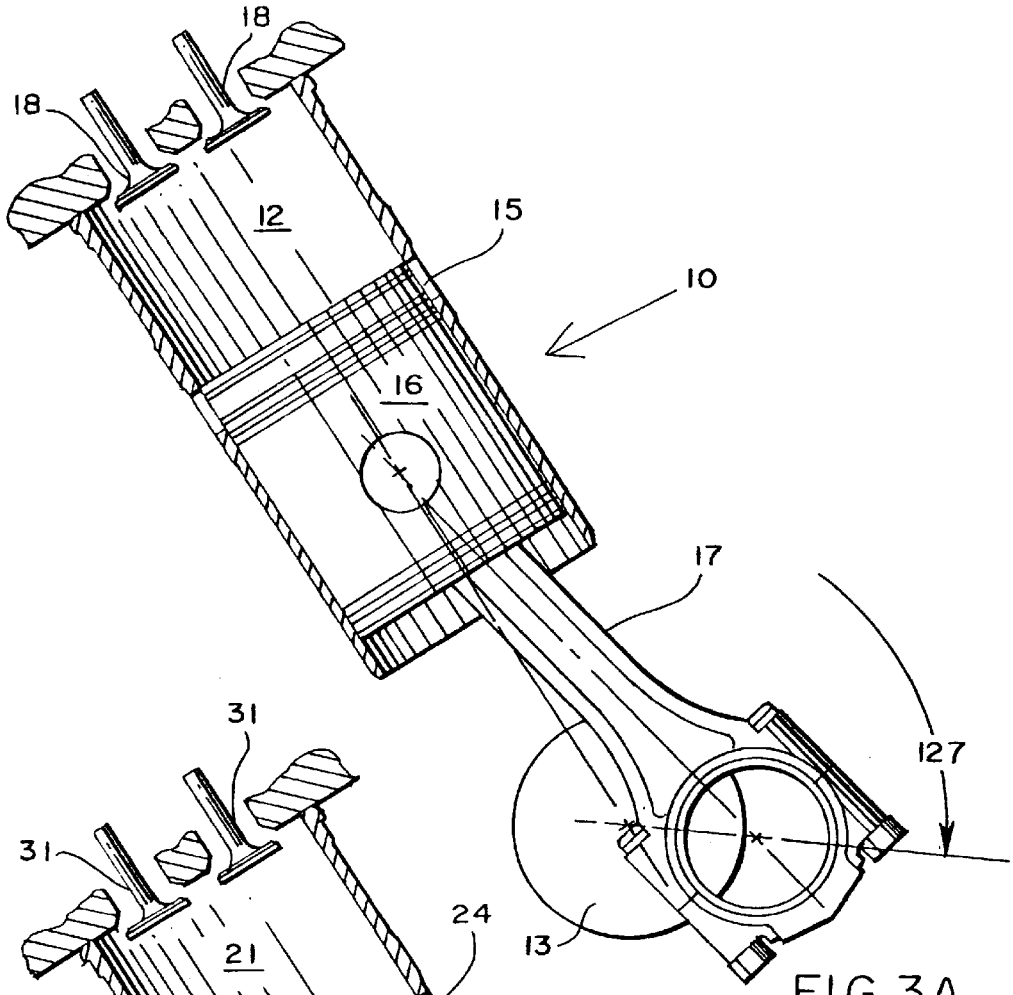
FIG. 3A PRIOR ART

FIG. 3A: During the remaining power stroke the crankshaft 13 rotates to 127° when the liner air intake ports 15 begin to open, at this point the piston 16 has travelled 4.20 inches and the exhaust valves have opened 0.254 inch.

Figure 3B:
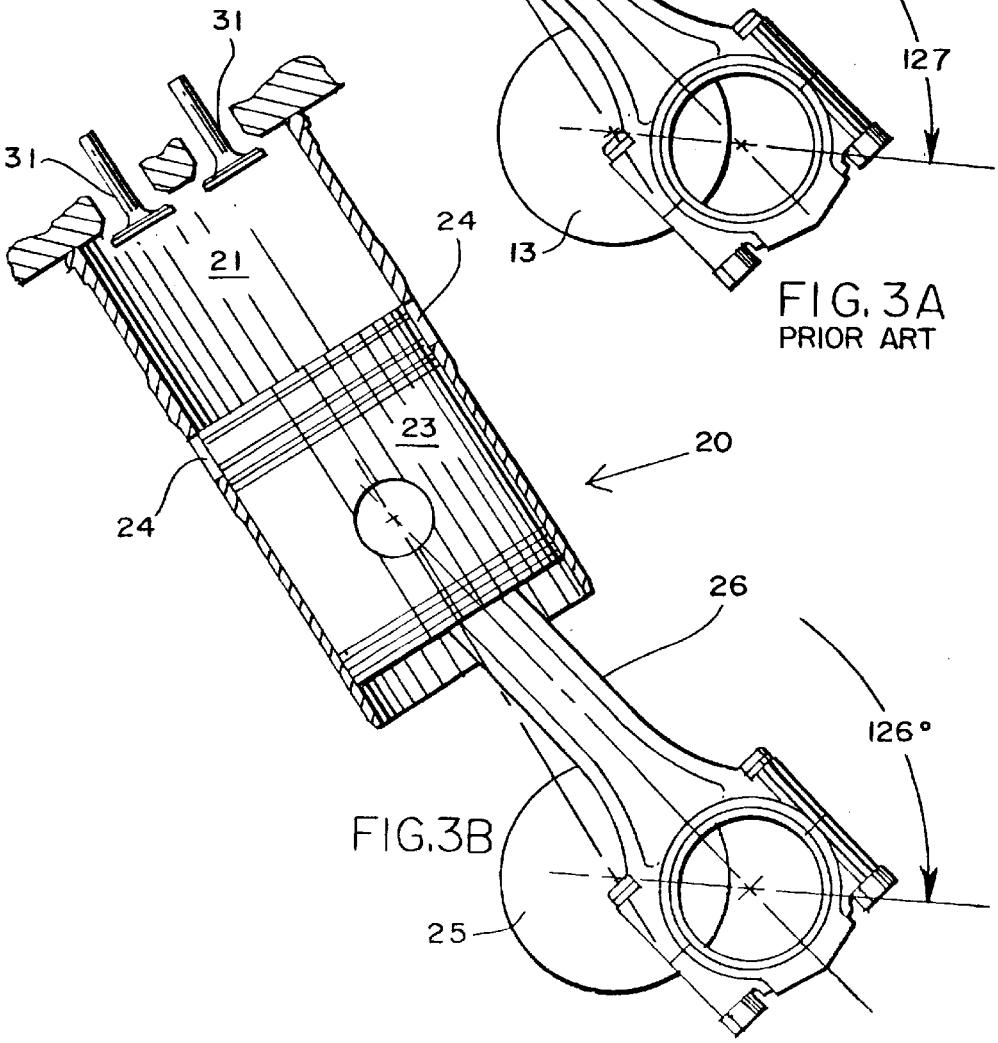

FIG. 3B: During the remaining power stroke the crankshaft 25 rotates to 126° when the liner air intake ports 24 begin to open, at this point the piston 23 has travelled 4.35 inches a 3.6% gain in overall power stroke. The exhaust valves 31 have opened 0.301 due to the increased ratio valve opening rocker arms. This is a gain of 30% in volumetric exhaust valve opening space at that point, for more efficient exhaust outflow.

Figure 4A:
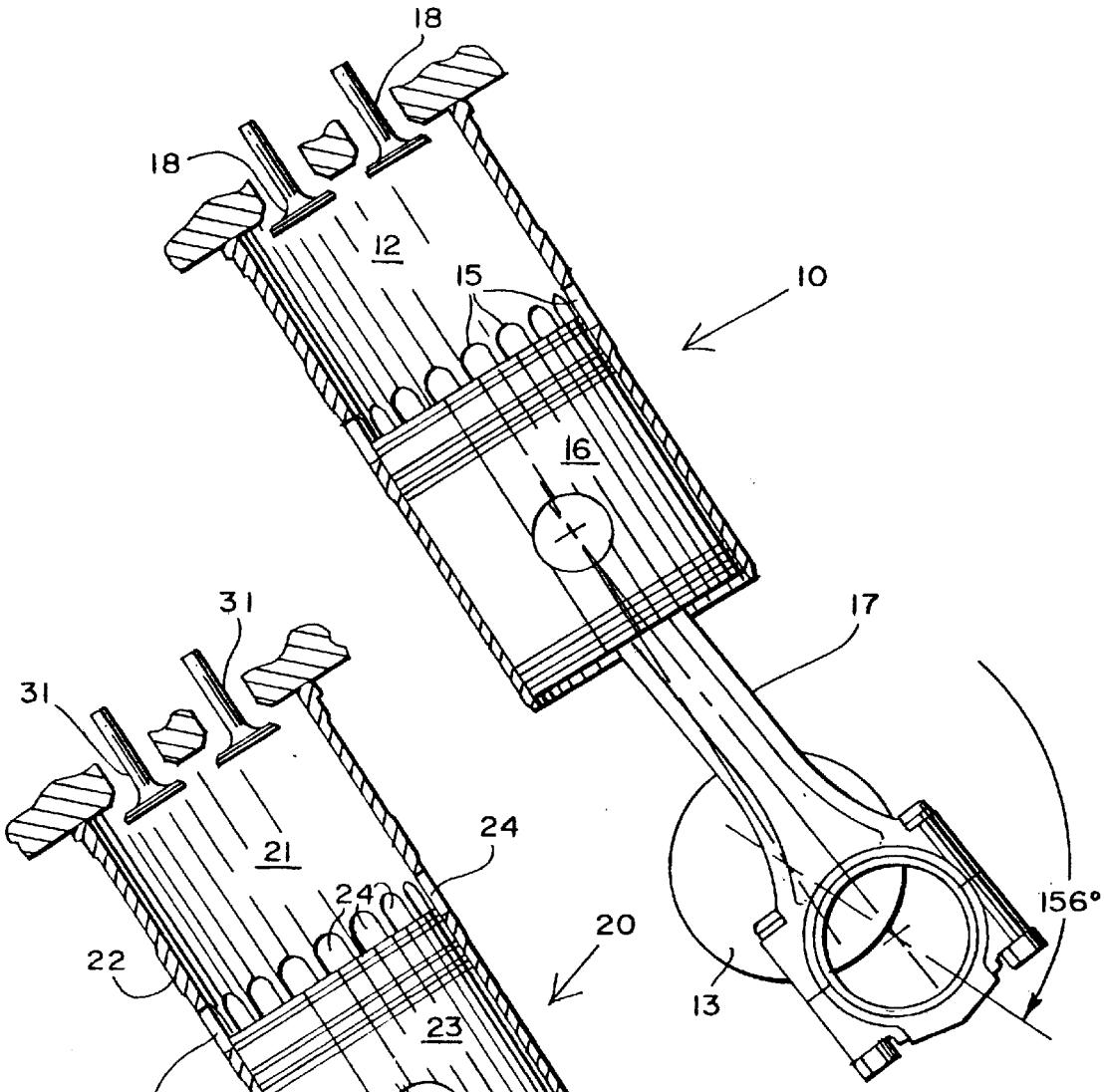
FIG.4A PRIOR ART

FIG. 4A: When the crankshaft 13 has rotated 156° now in the exhaust mode, the liner air intake ports 15 are open 0.635 inch and the exhaust valves 18 are open 0.390 inch, the piston 16 has travelled 4.835 inches.

Figure 4B:
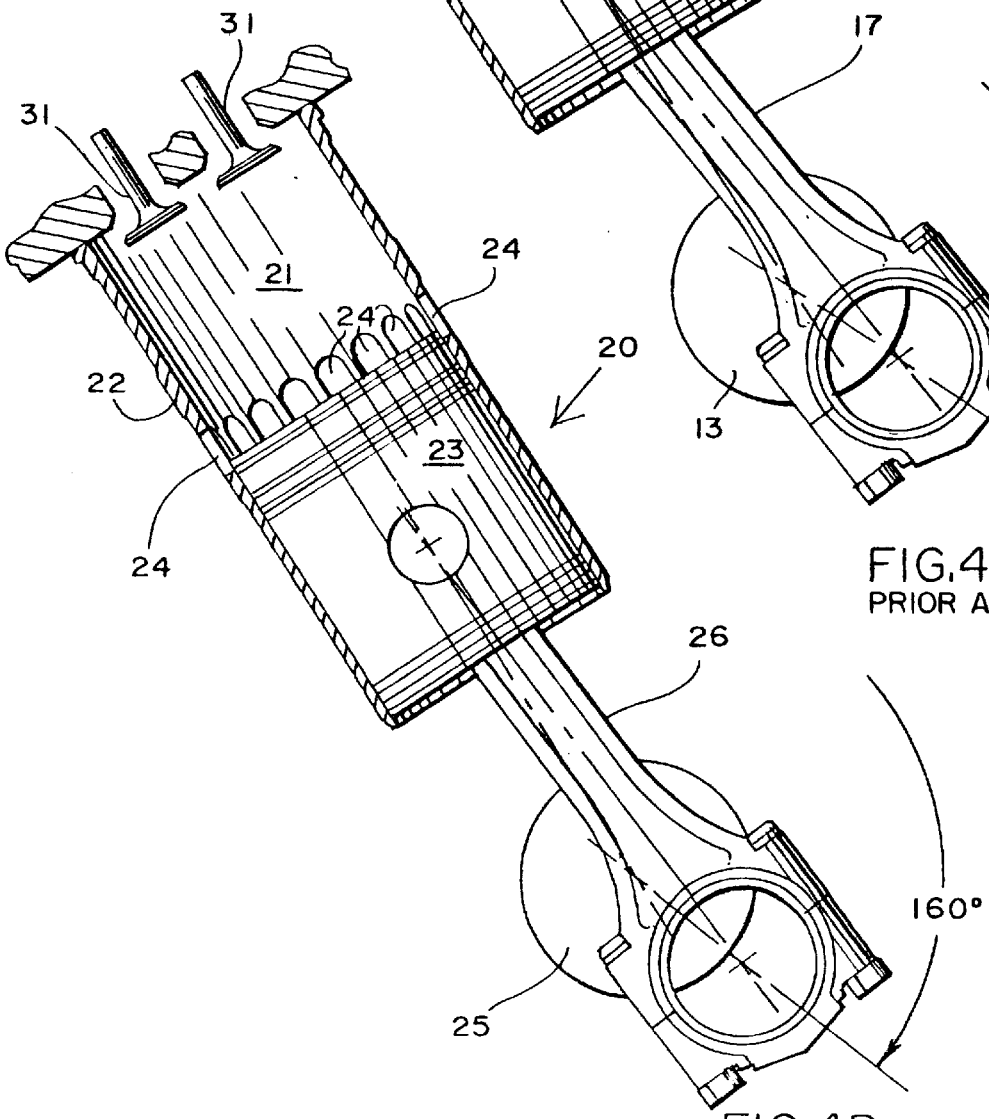

FIG. 4B: When the crankshaft 25 has rotated 160° now in the exhaust mode, the liner air intake ports 24 are open 0.733 inch, a 15% increase for fresh air charge, and the exhaust valves 3 are open 0.480 inch, a 35% increase for exhaust outflow volume. The piston has travelled 5.083 inches.

Figure 5A:
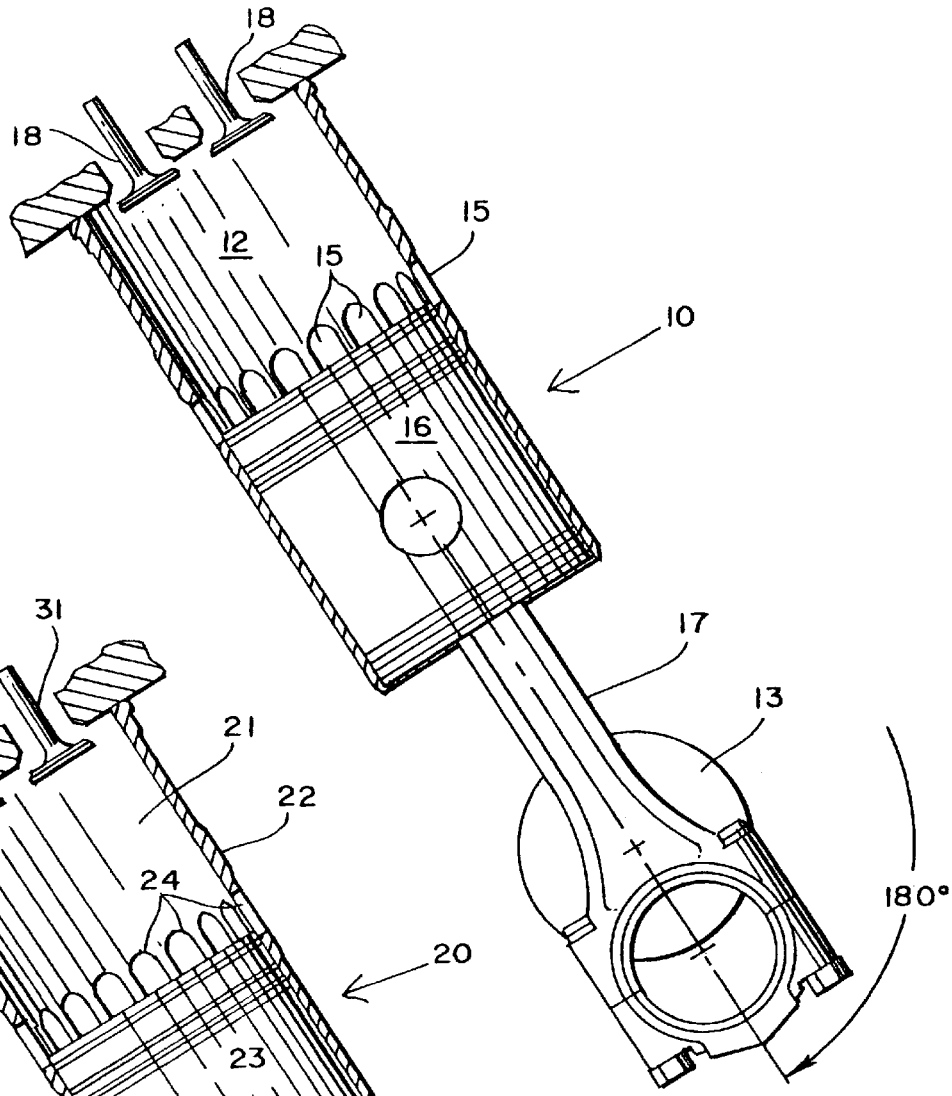
FIG.5A PRIOR ART

FIG. 5A: At 180° crankshaft 13 rotation with the prior art, the liner air inlet ports 15 are open to the maximum of 0.800 inch. The exhaust valves are open 0.320 inch. The piston 16 has travelled 5.00 inches from T.D.C.

Figure 5B:
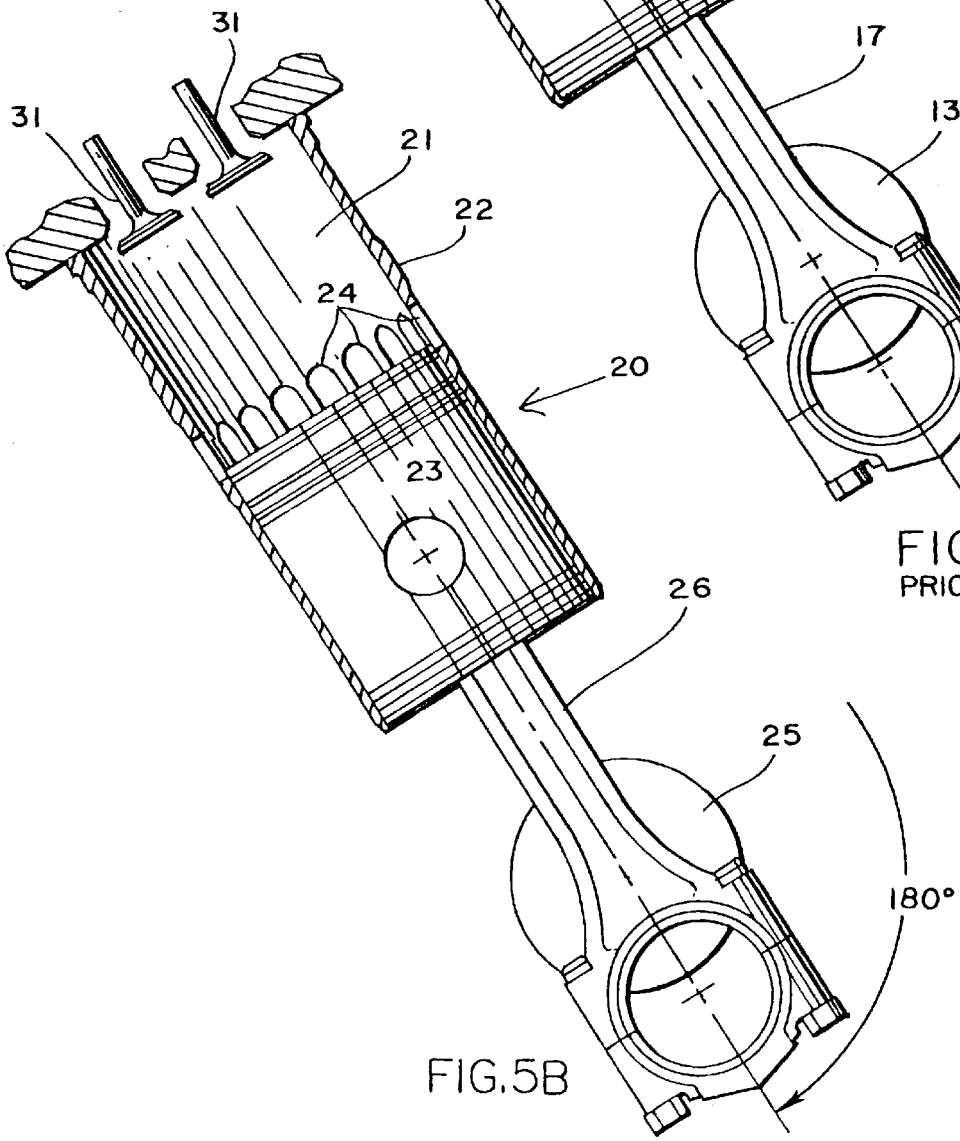

FIG. 5B: With the inventive engine 20, at 180° crankshaft 25 rotation the liner air inlet ports 24 are open 0.850 or a 6.4% increase in volume to allow better scavenging and increased charge air flow into the cylinder 21. The exhaust valves 31 are still open 0.430 inch, an increase of 35% in volume for exhaust gas out flow. The new piston 23 has travelled 5.200 inches from T.D.C. or an increase of 4% over the prior art.

Figures 6A, 6B:
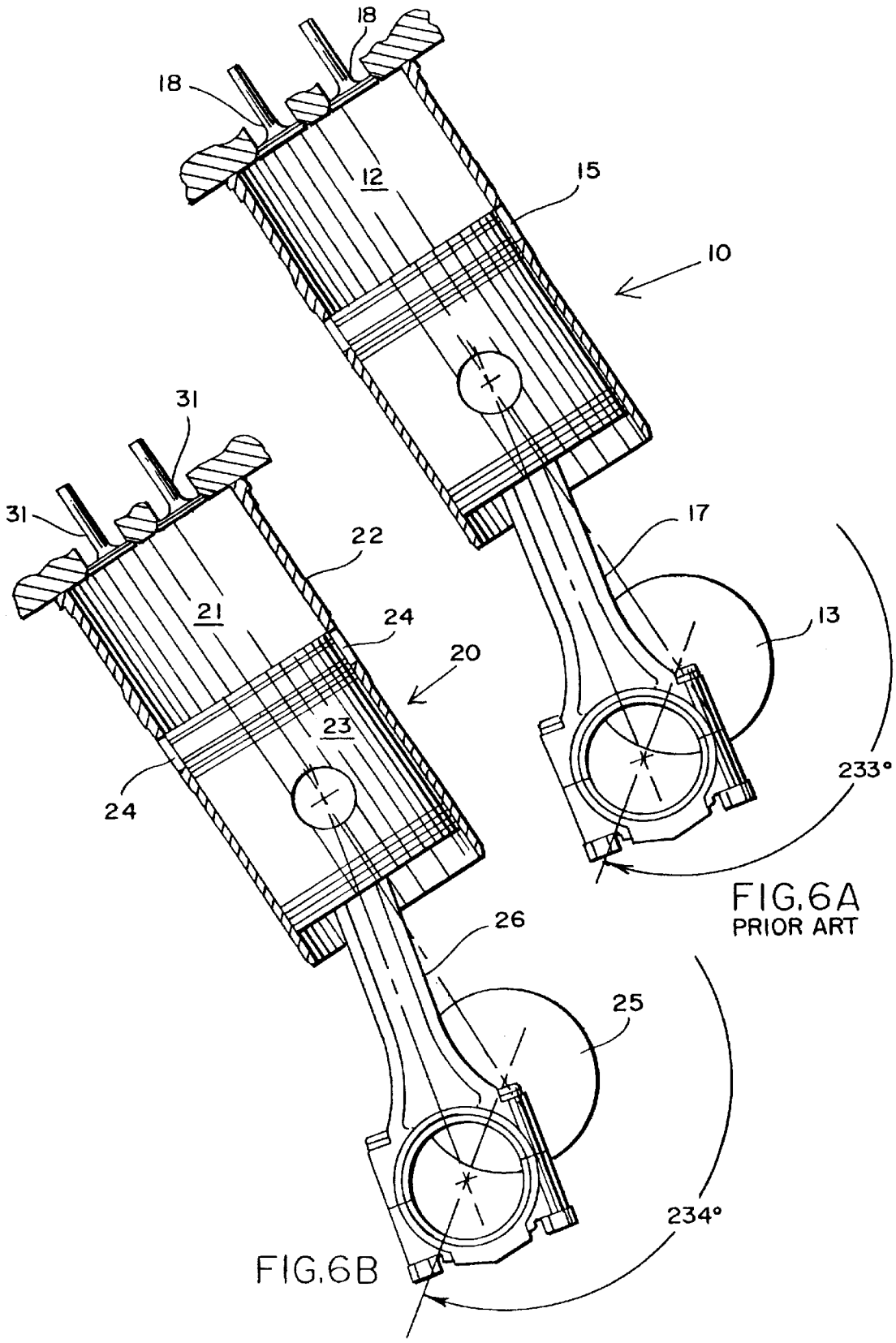
FIG.6A PRIOR ART

FIG. 6A: At 231° crankshaft rotation the exhaust valves 18 are open only 0.004 inch with the liner ports 15 still open 0.062 inch. At 233° rotation the liner ports 15 close with the exhaust valves 18 open only 0.002 inch. The piston 16 is now 4.200 inch from T.D.C.

FIG. 6B: At 234° crankshaft 25 rotation the exhaust valves 31 are still open 0.010 inch with the liner ports 24 closed preventing compression blow back. The piston 23 is 4.350 inch from T.D.C.

Figures 7A, 7B:
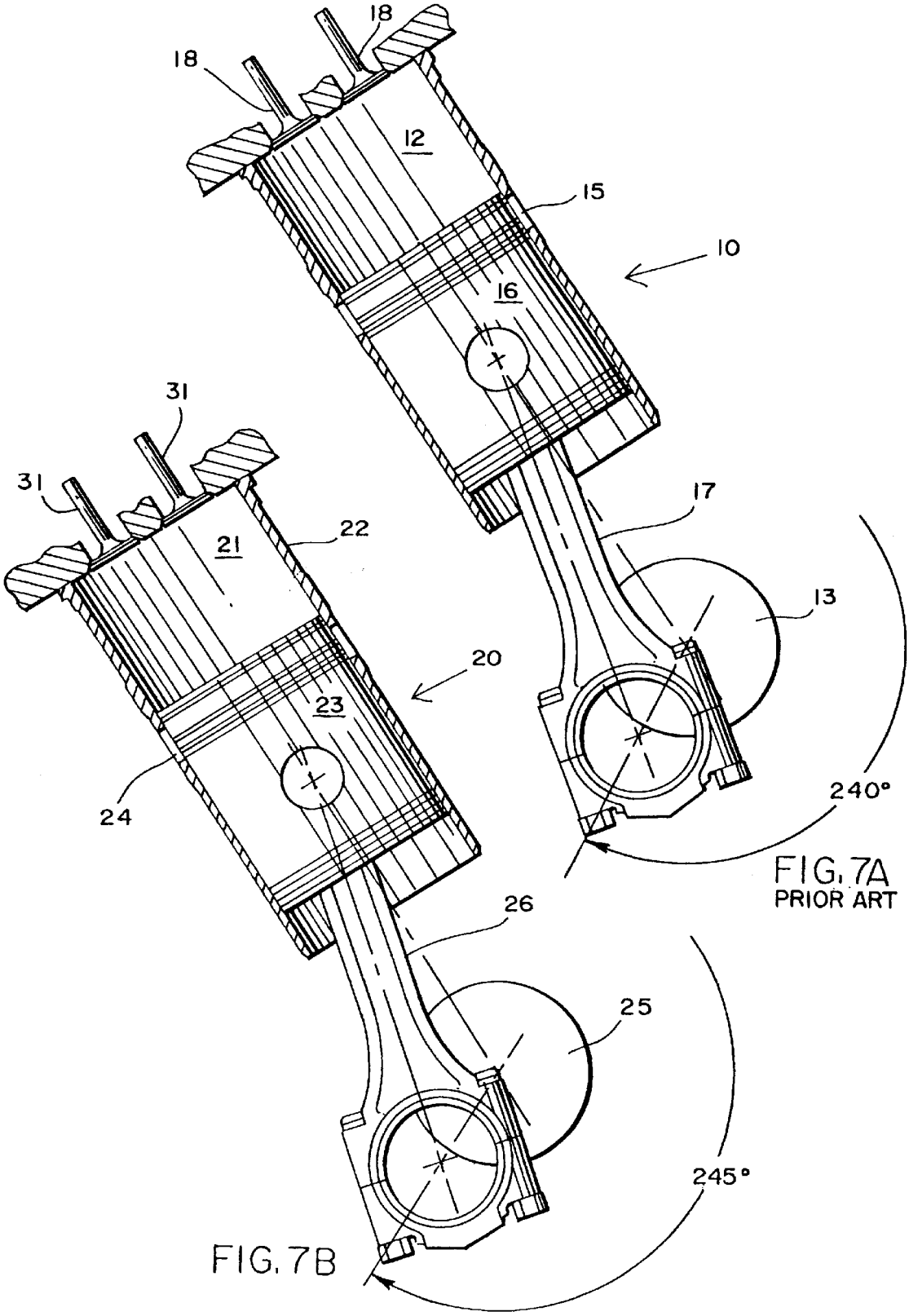
FIG. 7A PRIOR ART

FIG. 7A: At 240° crankshaft 13 rotation the exhaust valves 18 are completely closed. The piston 16 has closed the liner ports 15 and is 0.216 inch above ports 15. The compression stroke is from 240° to 360° 3.984 inch piston travel.

FIG. 7B: It will be seen that with the applicant's invention the compression stroke begins at 245° when the piston 23 closes the liner ports 24. As a consequence, the applicant's engine has a shorter compression stroke than that of the prior art as illustrated in FIG. 7A, but derives its efficiency from a more complete scavenging cycle, and the lengthened power stroke.

The foregoing summarized as to the prior art in the following Chart 1 describing FIGS. 1A–7A:

CHART 1

| DRAWING #9A | DEGREES ROT. | DESCRIPTION OF CYCLE | EXH. VALVE | PISTON TRAVEL | LINER PORTS |
|---|---|---|---|---|---|
| | O.T.D.C. | Fuel Injection | CLOSED | T.D.C. | CLOSED |
| 1A | 90 | Main Power Stroke | .001 OPEN | 2.814" | CLOSED |
| 2A | 120 | Remaining Power Stroke Exh. Cycle Started | .221 OPEN | 3.984" | CLOSED |
| 3A | 127 | Exh. Cycle Scavenging Starts | .254 OPEN | 4.200" | .001 OPEN |
| 4A | 156 | Exhaust and Scavenging | .390 OPEN MAX. | 4.035" | .635 OPEN |
| 5A | 180 B.D.C. | Scavenging and Air Charge | .320 OPEN | 5.00" | .800 OPEN |
| | 215 | Scavenging and Air Charge | .033 OPEN | 4.650" | .450 OPEN |
| 6A | 231 | Air Charge | .004 OPEN | 4.262" | .062 OPEN |
| | 233 | Start or Compression Stroke | .002 OPEN | 4.200" | CLOSED |
| 7A | 240 | Compression | CLOSED | 3.964" | CLOSED PISTON .216AB |
| | 240 TO 360 | Compression | CLOSED | 3.964 TO 0.0 | CLOSED |

The details of the invention are set forth below in Chart 2:

CHART 2

| DRAWING #9A | DEGREES ROT. | DESCRIPTION OF CYCLE | EXH. VALVE | PISTON TRAVEL | LINER PORTS |
|---|---|---|---|---|---|
| | O.T.D.C. | Fuel Injection | CLOSED | T.D.C. | CLOSED |
| 1B | 94 | Main Power Stroke | .001 OPEN | 3.123" | CLOSED |
| 2B | 120 | Remaining Power Stroke Exh. Cycle Started | .244 OPEN | 4.156" | CLOSED |

-continued

CHART 2

| DRAWING #9A | DEGREES ROT. | DESCRIPTION OF CYCLE | EXH. VALVE | PISTON TRAVEL | LINER PORTS |
|---|---|---|---|---|---|
| 3B | 126 | Exh. Cycle Scavenging Starts | .301 OPEN | 4.35" | .001 OPEN |
| 4B | 160 | Exhaust and Scavenging | .480 OPEN MAX. | 5.083" | .733 OPEN |
| 5B | 180 B.D.C. | Scavenging and Air Charge | .430 OPEN | 5.200" | .850 OPEN |
| | 215 | Scavenging and Air Charge | .070 OPEN | 4.841" | .491 OPEN |
| 6B | 234 | Scavenging Start of Compression | .010 OPEN | 4.350" | CLOSED |
| 7B | 245 | Compression | CLOSED | 3.950" | CLOSED PISTION 370AB |
| | 245 to 360 | Compression | CLOSED | 3.980 TO 0.0 | CLOSED |

While the invention is not to be limited to dimensions, but rather the timed relation of the various events in a two-stroke engine, comparison is made for illustrative purposes to the Detroit Diesel 92. More specifically, the piston rod 17 of the Detroit Diesel 92 from center to center of the pivots is 10.121 to 10.126 inches. The shortened piston rod 26 illustrative of the present invention, shows that the same center to center distance has been reduced by one hundred thousandths to approximately 10.021–10.026.

Similarly noting the crank shaft 13, the prior art crank shaft 13 the throw from the center line of the shaft to the center line of the piston rod engagement portion has been increased from 2.5 inches to 2.6 inches or one-tenth of an inch. This results in a two-tenth per inch lengthening of the power stroke.

The rocker arm push rod engagement distance to the pivot point of the prior art is 1.235 inches, while that of the invention is 1.124 inches. Thus, the ratio of the prior art which is 1.23:1 ratio, becomes 1.50:1 ratio of the two arms of the rocker arm illustrative of the present invention.

Finally, the intake ports 24 of the illustrative engine 20 have been lowered by 0.150 inches to conform to the increase of the power stroke brought about by increasing the throw of the crankshaft and decreasing the length of the piston rod.

Figure 10A:
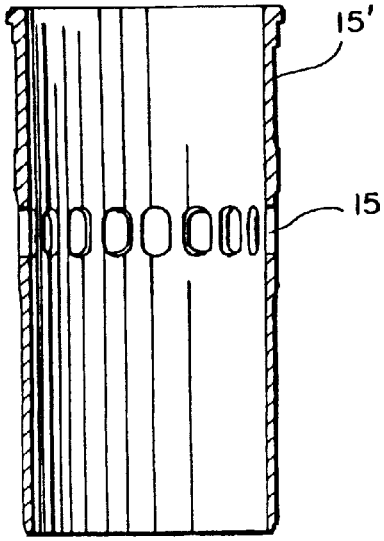
FIG.10A PRIOR ART
FIGS 10A illustrates a top view and vertical section of the liner for the prior-art Detroit Diesel 92.
Figure 10B:
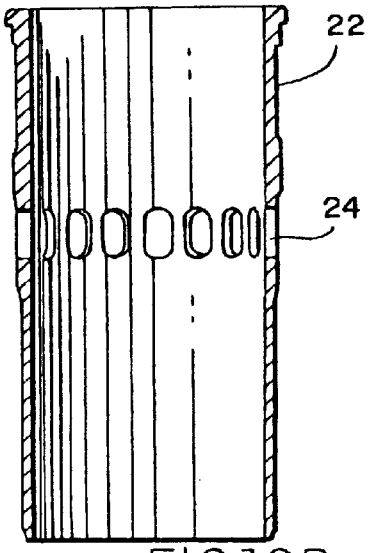
FIG. 10B illustrates the top view and vertical section of the liner as modified by the present invention.

The relationship between the cylinder liner and intake ports is illustrated in FIGS. 10A and 10B where the liner is shown in top view at the top (where the two are identical) and in section at the lower portion where the relationship differs. With the liner 15, of the Detroit Diesel Series 92 (FIG. 10A) it will be seen that the stroke is five inches, and the dome of the piston approaches within twenty thousandths of the top of the liner, and one hundred fifty thousandths of the bottom of the ports. The ports with the liner 22 illustrative of the present invention (FIG. 10B) are lowered to 4.370 inches from the top as contrasted with 4.220 inches with the prior art, or an increased distance of one hundred fifty thousandths. The stroke of the applicant's engine 20, however, is 5.2 inches or two hundred thousandths longer than that of the prior art. Thus, while the exhaust valve opens at 90° with the prior art, and 94° with the applicant's structure, the lowering of the port 24 and the lengthening of the port 24 by fifty thousandths causes applicant's piston to uncover the ports 24 at 126° of rotation of the crankshaft, as contrasted with 127° of the crankshaft 13 of the Detroit Diesel Series 92. The additional travel of the power stroke coupled with the more than 50% increased opening stroke of the exhaust valve 18 of the applicant's design contributes to more efficient combustion, a longer power stroke, a reduction of the back pressure at the tine the ports are open, and a minimization of the reverse intake which is otherwise caused by the power stroke not having totally dissipated the thermal energy into kinetic energy with the Series 92, and retaining a residual pressure interiorly of the cylinder when the ports are open which is greater than the pressure generated by the blower and turbo boost.

Figure 9A:
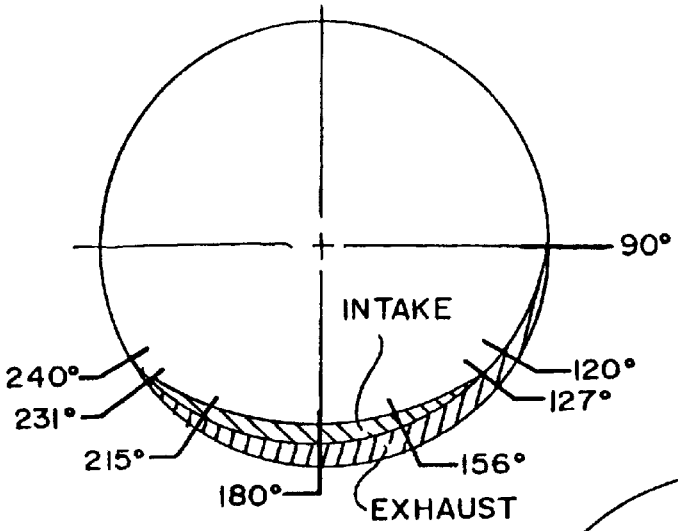
FIG.9A PRIOR ART
FIG. 9A is a circle diagram of the various events in the cycle of the prior art Detroit Diesel 92.
Figure 9B:
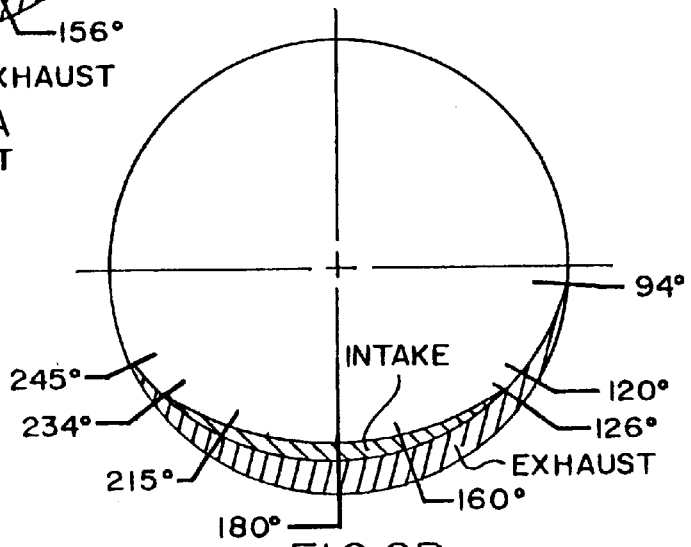
FIG. 9B is a comparable view to FIG. 9A but illustrating the present invention.

While the foregoing is translated into dimensions for the Detroit Diesel 92 as described previously, the dimensions are not intended to be limiting. Rather, the engine described takes on the new characteristics of the two-cycle stroke when FIG. 9A is compared to FIG. 9B and the relationship by degrees of the prior art is directed to that exemplary of the present invention. Accordingly, the thrust of the present invention resides in the cycle as illustrated in FIG. 9B, to the exclusion of the cycle shown in FIG. 9A. The cycles of the two engines are basically the same from a standpoint of sequence. They differ, however, in the timed relationship of the four principal aspects of the sequence as illustrated in FIGS. 8A–8D.

In actual practice, it is possible to modify the Detroit Diesel 92, or other two-stroke diesels. The basic steps are to develop a new piston/cylinder sleeve which is the basic sleeve of the prior art, but in which the ports are machined to a lower position to accommodate the length of the power stroke. The liner is extended downwardly also, in practice 0.190 inch. The lowering is desirably slightly less than the lengthening of the power stroke. Similarly, the piston rods are machined to be shorter and the throw of the crankshaft is machined to be longer to the end that the power stroke of the cycle is increased by the lengthening of the power stroke 5%. As to the exhaust, that change is accomplished by providing a rocker arm in which the ratio between the length of the portion engaged by the push rod and the portion engaging the valve stem is increased from 1.23:1 to 1.50:1. Depending upon the timing of the engine, the cam shaft which activates the push rod and the exhaust valve is rotated to retard the beginning of the exhaust cycle to conform to the increased length of the power stroke to the end that the exhaust cycle portion remains essentially the same degrees, but retarded to take advantage of the lengthened power stroke.

In summary it will be observed that there has been no basic change in the sequence of scavenging, compression, power, and exhaust of a standard two-stroke cycle diesel engine. What has been changed, and which dramatically effects performance, is the length of the power stroke by a combination of increasing the crank shaft throw and decreasing the piston rod length. This is coordinated with lowering the ports on the piston/cylinder sleeve an amount approximately the same as the increased length of the power stroke. The exhaust valve has its opening increased by changing the ratio of the two arms of the rocker arm from 1.23:1 to 1.50:1. The exhaust valve opening is delayed an amount approximately the same as the increase in the length of the power stroke. Similarly the ports are lowered to accommodate the increased length of the power stroke and lowered approximately the same amount as the increase in the length of the power stroke.

The results in performance are most meaningful. By comparing a prior art Detroit Diesel 92 with the modified same engine in accordance with the present invention, it was noted that the prior-art (8V92 T.A.B.) engine at 2300 rpm produced, 735 horsepower delivering 18.37 horsepower per gallons per hour. At 2300 rpm, with the modifications in accordance with the present invention, the prior-art performance was increased to producing 886 horsepower at 2300 rpm, and producing 21.09 horsepower per gallon per hour. Thus, a total horsepower increase from 735 delivering 18.37 horsepower per gallon per hour was increased in the same basic engine to 886 horsepower, or an increase of 151 horsepower and an increase from 18.37 horsepower per gallon per hour to 21.09 horsepower per gallon per hour. Each of these increases is in the realistic range of 20% to 25% both from a standpoint of overall performance, as well as from a standpoint of fuel efficiency. Moreover, the testing performed under hard acceleration, rapid deceleration, and heavy overload conditions exhibited no excessive engine wear more than would have been experienced with an unmodified engine. This, therefore, results in cleaner exhaust emissions, a reduction of fuel requirement, longer engine component life. Also improved horsepower-to-engine weight ratio results which also improves fuel economy. Moreover, there is less engine vibration due to more efficient conversion of fuel, and cost-effectiveness inasmuch as no new parts are required, the only changes being in the position, orientation, spacial relationships, and cyclic timing of the parts of a pre-existing engine.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. In a diesel engine having the characteristics of Chart 1 below:

| DRAWING #9A | DEGREES ROT. | DESCRIPTION OF CYCLE | EXH. VALVE | PISTON TRAVEL | LINER PORTS |
|---|---|---|---|---|---|
| | O.T.D.C. | Fuel Injection | CLOSED | T.D.C. | CLOSED |
| 1A | 90 | Main Power Stroke | .001 OPEN | 2.814" | CLOSED |
| 2A | 120 | Remaining Power Stroke Exh. Cycle Started | .221 OPEN | 3.984" | CLOSED |

-continued

| DRAWING #9A | DEGREES ROT. | DESCRIPTION OF CYCLE | EXH. VALVE | PISTON TRAVEL | LINER PORTS |
|---|---|---|---|---|---|
| 3A | 127 | Exh. Cycle Scavenging Starts | .254 OPEN | 4.200" | .001 OPEN |
| 4A | 156 | Exhaust and Scavenging | .390 OPEN MAX. | 4.035" | .635 OPEN |
| 5A | 180 B.D.C. | Scavenging and Air Charge | .320 OPEN | 5.00" | .800 OPEN |
| | 215 | Scavenging and Air Charge | .033 OPEN | 4.650" | .450 OPEN |
| 6A | 231 | Air Charge | .004 OPEN | 4.262" | .062 OPEN |
| | 233 | Start of Compression Stroke | .002 OPEN | 4.200" | CLOSED |
| 7A | 240 | Compression | CLOSED | 3.964" | CLOSED .216AB |
| | 240 to 360 | Compression | CLOSED | 3.964 to 0.0 | CLOSED |

the improvement comprising modifying the engine of Chart 1 to conform to the characteristics set forth in Chart 2 below:

| DRAWING #9A | DEGREES ROT. | DESCRIPTION OF CYCLE | EXH. VALVE | PISTON TRAVEL | LINER PORTS |
|---|---|---|---|---|---|
| | O.T.D.C. | Fuel Injection | CLOSED | T.D.C. | CLOSED |
| 1B | 94 | Main Power Stroke | .001 OPEN | 3.123" | CLOSED |
| 2B | 120 | Remaining Power Stroke Exh. Cycle Started | .244 OPEN | 4.156" | CLOSED |
| 3B | 126 | Exh. Cycle Scavenging Starts | .301 OPEN | 4.350" | .001 OPEN |
| 4B | 160 | Exhaust and Scavenging | .480 OPEN MAX. | 5.083" | .733 OPEN |
| 5B | 180 B.D.C. | Scavenging and Air Charge | .430 OPEN | 5.083" | .733 OPEN |
| | 215 | Scavenging and Air Charge | .070 OPEN | 4.841" | .491 OPEN |
| 6B | 234 | Scavenging Start of Compression | .010 OPEN | 4.350" | CLOSED OPEN |
| 7B | 245 | Compression | CLOSED | 3.980" | CLOSED, .370AB |
| | 245 to 360 | Compression | CLOSED | 3.980 TO 0.0 | CLOSED |

2. The method of upgrading a two-stroke diesel engine having the characteristics of Chart 1 below:

| DRAWING #9A | DEGREES ROT. | DESCRIPTION OF CYCLE | EXH. VALVE | PISTON TRAVEL | LINER PORTS |
|---|---|---|---|---|---|
| | O.T.D.C. | Fuel Injection | CLOSED | T.D.C. | CLOSED |
| 1A | 90 | Main Power Stroke | .001 OPEN | 2.814" | CLOSED |
| 2A | 120 | Remaining Power Stroke Exh. Cycle Started | .221 OPEN | 3.984" | CLOSED |
| 3A | 127 | Exh. Cycle Scavenging Starts | .254 OPEN | 4.200" | .001 OPEN |
| 4A | 156 | Exhaust and | .390 OPEN MAX. | 4.035" | .635 OPEN |

-continued

| DRAWING #9A | DEGREES ROT. | DESCRIPTION OF CYCLE | EXH. VALVE | PISTON TRAVEL | LINER PORTS |
|---|---|---|---|---|---|
| | | Scavenging | | | |
| 5A | 180 B.D.C. | Scavenging and Air Charge | .320 OPEN | 5.00" | .800 OPEN |
| | 215 | Scavenging and Air Charge | .033 OPEN | 4.650" | .450 OPEN |
| 6A | 231 | Air Charge | .004 OPEN | 4.262" | .062 OPEN |
| | 233 | Start or Compression Stroke | .002 OPEN | 4.200" | CLOSED |
| 7A | 240 | Compression | CLOSED | 3.964" | CLOSED .216AB |
| | 240 TO 360 | Compression | CLOSED | 3.964 TO 0.0 | CLOSED |

each and every step of modifying the stroke, exhaust, intake, and compression and their related components of piston, cylinder, connecting rod, crankshaft throw, and exhaust valve comprising modifying each to conform to the characteristics of Chart 2 below:

| DRAWING #9A | DEGREES ROT. | DESCRIPTION OF CYCLE | EXH. VALVE | PISTON TRAVEL | LINER PORTS |
|---|---|---|---|---|---|
| | O.T.D.C. | Fuel Injection | CLOSED | T.D.C. | CLOSED |
| 1B | 94 | Main Power Stroke | .001 OPEN | 3.123" | CLOSED |
| 2B | 120 | Remaining Power Stroke Exh. Cycle Started | .244 OPEN | 4.156" | CLOSED |
| 3B | 126 | Exh. Cycle Scavenging Starts | .301 OPEN | 4.350" | .001 OPEN |
| 4B | 160 | Exhaust and Scavenging | .480 OPEN MAX. | 5.083" | .733 OPEN |
| 5B | 180 B.D.C. | Scavenging and Air Charge | .430 OPEN | 5.00" | .850 OPEN |
| | 215 | Scavenging and Air Charge | .070 OPEN | 4.841" | .491 OPEN |
| 6B | 234 | Scavenging and of Compression | .010 OPEN | 4.350" | CLOSED |
| 7B | 245 | Compression | CLOSED | 3.980" | CLOSED .216AB |
| | 240 TO 360 | Compression | CLOSED | 3.964 TO 0.0 | CLOSED |

3. A diesel engine of the two-stroke type which has been modified from the clock diagram below:

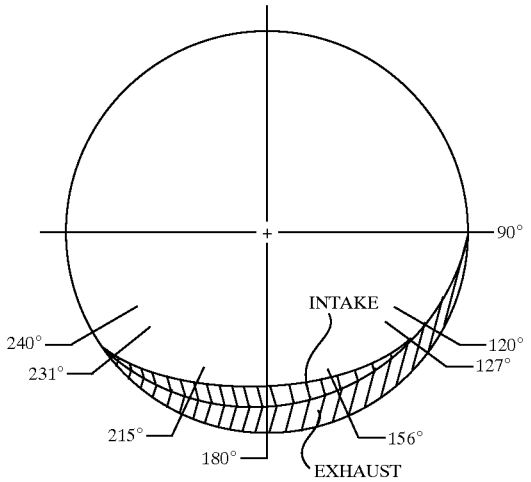

by changing the characteristics of the piston, cylinder, cylinder sleeve, scavenging ports, connecting rod, crankshaft throw, and timing to conform to the clockwork diagram below:

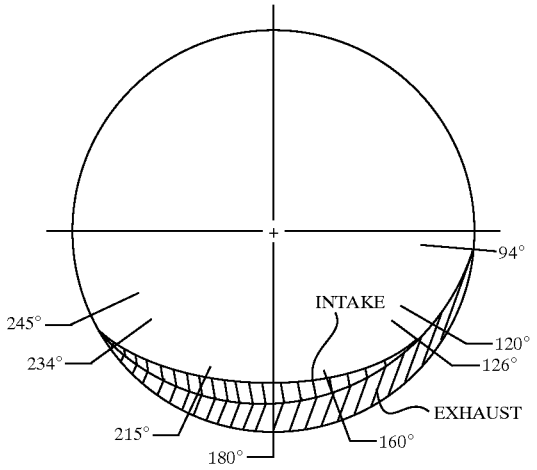

4. The method of modifying a two-stroke diesel engine having the clockwork characteristics of the figure below:

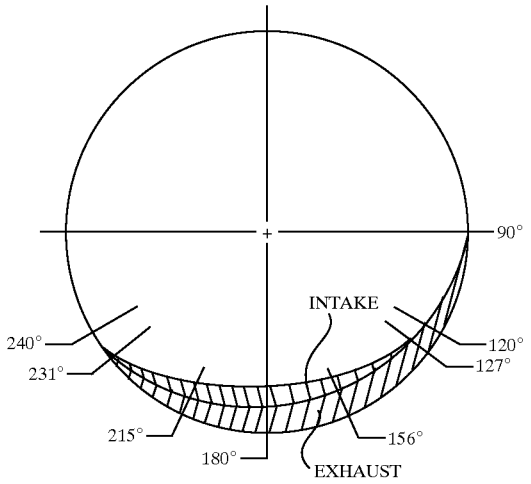
comprising the steps of modifying the piston, piston rod, crankshaft throw, cylinder liner and intake ports, and exhaust stroke of the same to conform to the clockwork diagram below:
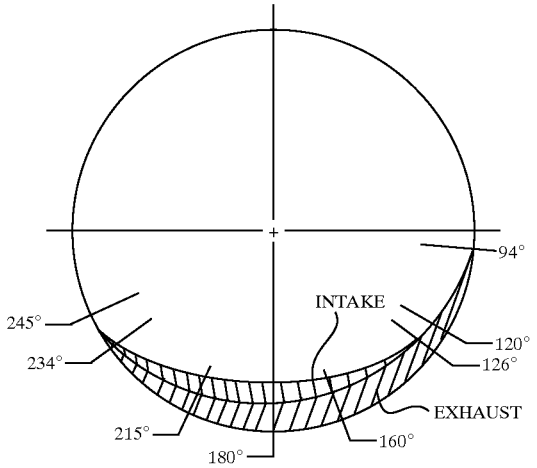
* * * * *